United States Patent [19]

Schröder

[11] Patent Number: 4,492,288

[45] Date of Patent: Jan. 8, 1985

[54] GROUP CONTROL FOR ELEVATORS CONTAINING AN APPARATUS FOR CONTROLLING THE DOWN-PEAK TRAFFIC

[75] Inventor: Joris Schröder, Lucerne, Switzerland

[73] Assignee: Inventio AG, Hergiswil, Switzerland

[21] Appl. No.: 476,991

[22] Filed: Mar. 21, 1983

[30] Foreign Application Priority Data

Apr. 8, 1982 [CH] Switzerland ..... 2187/82

[51] Int. Cl.[3] ..... B66B 1/18

[52] U.S. Cl. ..... 187/29 R

[58] Field of Search ..... 187/29, 29 R

[56] References Cited

U.S. PATENT DOCUMENTS

| | | | |
|---|---|---|---|
| 2,104,478 | 1/1938 | Eames | 187/29 |
| 3,073,417 | 1/1963 | Lusti | 187/29 |
| 3,315,765 | 4/1967 | Dinning | 187/29 |
| 3,645,361 | 2/1972 | Stichweh et al. | 187/29 R |
| 4,044,860 | 8/1977 | Kaneko et al. | 187/29 R |
| 4,129,199 | 12/1978 | MacDonald | 187/29 R |
| 4,210,227 | 7/1980 | Zeindler et al. | 187/29 R |
| 4,263,989 | 4/1981 | Zeindler et al. | 187/29 R |
| 4,355,705 | 10/1982 | Schröder et al. | 187/29 R |
| 4,411,337 | 10/1983 | Schröder et al. | 187/29 R |

FOREIGN PATENT DOCUMENTS

| | | |
|---|---|---|
| 0032213 | 12/1980 | European Pat. Off. . |
| 2357469 | 2/1978 | France . |

*Primary Examiner*—William M. Shoop
*Assistant Examiner*—Paul Shik Luen Ip
*Attorney, Agent, or Firm*—Werner W. Kleeman

[57] ABSTRACT

By means of the group control the average time losses for the passengers resulting from the waiting time at the floors and the return travel time are minimized. Therefore, the number of entering stops causing a minimum of time losses is determined per elevator car on the basis of calculations. The number of entering stops is stored in monitoring or control counters by means of which the allocation of down hall calls is limited to the number stored for each car. The down hall calls are combined by means of a switching circuit to form groups of chronologically inputted or incoming hall calls of a volume corresponding to the number of hall calls respectively stored in the monitoring or control counter. In the case of an increase in the hall calls, the earliest group of hall calls is first increased and the latest group of hall calls last. The increase of numbers in the group occurs by transfer of a hall call from the next later group of hall calls and the latest hall call is allocated to the latest group of hall calls. Thus, groups of hall calls are formed, each of which have the same size until the control counting state or level of the monitoring or control counter is reached. The groups of hall calls are allocated to the different cars such that the average time losses of the passengers become a minimum.

7 Claims, 6 Drawing Figures

D[sek]
120
110
100
90
Dmin.
L=13
D
L=13
T
W,T[sek]
HC
P6'
P6
50
40
30
20
10
0
P5'
P5
BR=6
BR=4
P4'
P4
BR=3
P7
BR=2
W
L=13
HC
L=13
L=10
L=8
L=6
L=4
L=2
L=3
L=12
BR=1
3,61
B
1
2
3
4
5
6
7
8
9
10
11
12

RTT, W [sek]
180
160
100
80
60
10
L=12
RTT12
1
1,5
BR
RTT6
2
L=6
3
4
6
RTT3
L=3
BR=12
4
3
2
W12
L=12
1,5
1
P1
6
L=6
BR'
L=3
P2
W6
W3
B
0
1
2
3
4
6
8
12

D[sek]

120
100
Dmin 13
50
P3
B
0
1
2
3
4
6
8
10
12
L=13
L=12
D13
D12
L=10
D10
BR
L=8
D8
L=6
D6
L=4
D4
L=3
D3
L=2
D2
m
1,5
1
2
3
4
6

GROUP CONTROL FOR ELEVATORS CONTAINING AN APPARATUS FOR CONTROLLING THE DOWN-PEAK TRAFFIC

CROSS REFERENCE TO RELATED APPLICATIONS

This application is related to my commonly assigned, copending United States application Ser. No. 06/281,567, filed July 9, 1981, entitled, "Group Control for Elevators", which is a continuation-in-part application of my likewise commonly assigned United States application Ser. No. 06/210,007, filed Nov. 24, 1980, entitled, "Group Control for Elevators", now U.S. Pat. No. 4,355,705, granted Oct. 26, 1982.

BACKGROUND OF THE INVENTION

The present invention relates to a new and improved group control for elevators containing an apparatus for controlling the descent peak down-peak traffic, by means of which a defined number of descent or down storey or hall calls is allocated to each cabin in the elevator group.

Group controls containing such apparatus serve the purpose of controlling the elevators of the group in the event of extreme collective traffic in the direction of the ground floor or any other primary stop or landing which, for example, may occur in an office building with unstaggered office closing or quiting times or at the end of visiting hours in hospitals. By means of the group control short and balanced waiting periods or times or intervals are intended to be realized for the passengers. The apparatus may be activated either by means of a timer switch or by means of a measuring device determining the flow of traffic in the direction of the primary stop or landing of the building. Simultaneously, the servicing of ascent or up calls may be reduced or totally eliminated.

In a state-of-the-art group control as known, for example, from German Patent Publication No. 1,803,648 the storeys or floors are divided into groups of fixed zones. The elevator system switches to the descent peak or down-peak operation or mode when a predetermined number of descent or down calls is exceeded in more than one zone or when a descending elevator cabin or car is fully occupied. During that operational mode an allocation device compares the number of registered descent or down calls with the number of cabins or cars used to answer the same. When the ratio of the two numbers exceeds a predetermined value a further cabin or car is incorporated into the servicing operation.

The control now operates in such a manner that a first cabin or car which, for example, is allocated to descent or down calls in an upper zone travels to the call originating from the highest storey or floor in this zone, while a second cabin or car which is also allocated to this zone answers or services the highest descent or down call in a lower section of the same zone. When the first cabin or car is allocated to the upper zone it is also excluded from the descent peak traffic. When descent or down calls are simultaneously present in a lower zone, the second cabin or car will be allocated to the lower zone and answers or services the call from the highest storey or floor in this zone even though the number of predetermined descent or down calls in the upper zone may be exceeded. In this manner an alternating preferred servicing of the zones and balanced waiting periods or times are intended to be achieved.

It is comtemplated with this control system to allocate only a predetermined number of descent or down calls to be serviced by each cabin or a car for achieving minimum waiting periods or times by fixing this predetermined number, and thus, the entering stops for each cabin or car as well as by alternating preferred servicing of the zones. However, it will be evident from the foregoing that the predetermined number of entering stops of a cabin or car may be considerably exceeded in certain cases, so that minimum waiting periods or times can hardly be achieved. A further disadvantage is that cabins or cars which are fully occupied by having answered or serviced descent or down calls of the upper zone sections no longer can service descent or down calls present in the lower zone sections, so that additional means have to be employed to eliminate this disadvantage.

One difficulty in the conception of such controls arises with regard to the determination of the optimum number of entering stops per cabin or car. Since some uncertainties exist in this respect, a small number like for example, two is used in practice, and there is accepted the fact that this number may be possibly considerably exceeded.

SUMMARY OF THE INVENTION

Therefore, with the foregoing in mind it is a primary object of the present invention to provide a new and improved group control for elevators containing an apparatus for controlling the descent or down-peak traffic, which is not afflicted with the aforementioned drawbacks and limitations of the prior art heretofore discussed.

Another important object of the present invention is directed to the provision of a new and improved group control for elevators containing an apparatus for controlling the descent peak or down-peak traffic in which the optimum number of entering stops per cabin or cam can be determined.

Still a further important object of the present invention is directed to a new and improved group control for elevators containing an apparatus for controlling the descent peak or down-peak traffic in which the number of descent or down storey calls are allocated to the elevator cabins or cars such that the average system time of a passenger during collective operation, for example, for emptying a building is minimized, such average system time being composed of the average waiting period or time and the return travel time.

Another significant object of the present invention is directed to a new and improved group control for elevators containing an apparatus for controlling the descent peak or DOWN-peak traffic which results in an increase in the conveying capacity of the elevator group.

Now in order to implement these and still further objects of the invention, which will become more readily apparent as the description proceeds, the group control of the present development is manifested by the features that, a calculation is provided by means of which the entering stops at which the average system time reaches minimum values can be determined per cabin or car. The greatest number of such entering stops is stored in a monitoring or control counter by means of which the allocation of descent or down story or hall calls is limited to the number per cabin or car stored in the monitoring or control counter. By means of a switching circuit the storey or hall calls are combined into groups of chronologically incoming or inputted calls, the volume of which is equal to the number respectively stored in the monitoring or control counter. The groups of calls are respectively allocated to that cabin or car which most rapidly can answer the topmost call of a group of storey or hall calls. The groups of calls are formed in such a manner that with increasing call numbers the earliest or oldest group of calls is first increased and then the latest or most recent group of calls is increased last. The increase of the group of calls occurs in each case by transfer of a call from the next later group of calls while the latest or most recent call is allocated to the latest group of calls. In each case, groups of calls having the same volume are formed until the control counter state or level of the monitoring or control counter is reached.

The advantages achieved by the group control according to the invention are essentially that by means of the proposed switching circuit for forming the storey or hall call groups minimum average system times can be achieved. Using the suggested calculation data the most favorable number of entering stops can be determined for achieving the minimum average system time of a passenger. Furthermore, it can be concluded with advantage from the calculation data that it would be inconvenient to reduce the waiting period or time by increasing the number of entering stops since, then, the system time would strongly increase. A further advantage is achieved by adapting the storey or hall call group volume to the respective traffic conditions by determining the most frequently occurring entering rate and thereby the arrival load to be expected. It thus becomes possible to increase the conveying capacity of the elevator group at approximately the same minimum system time.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
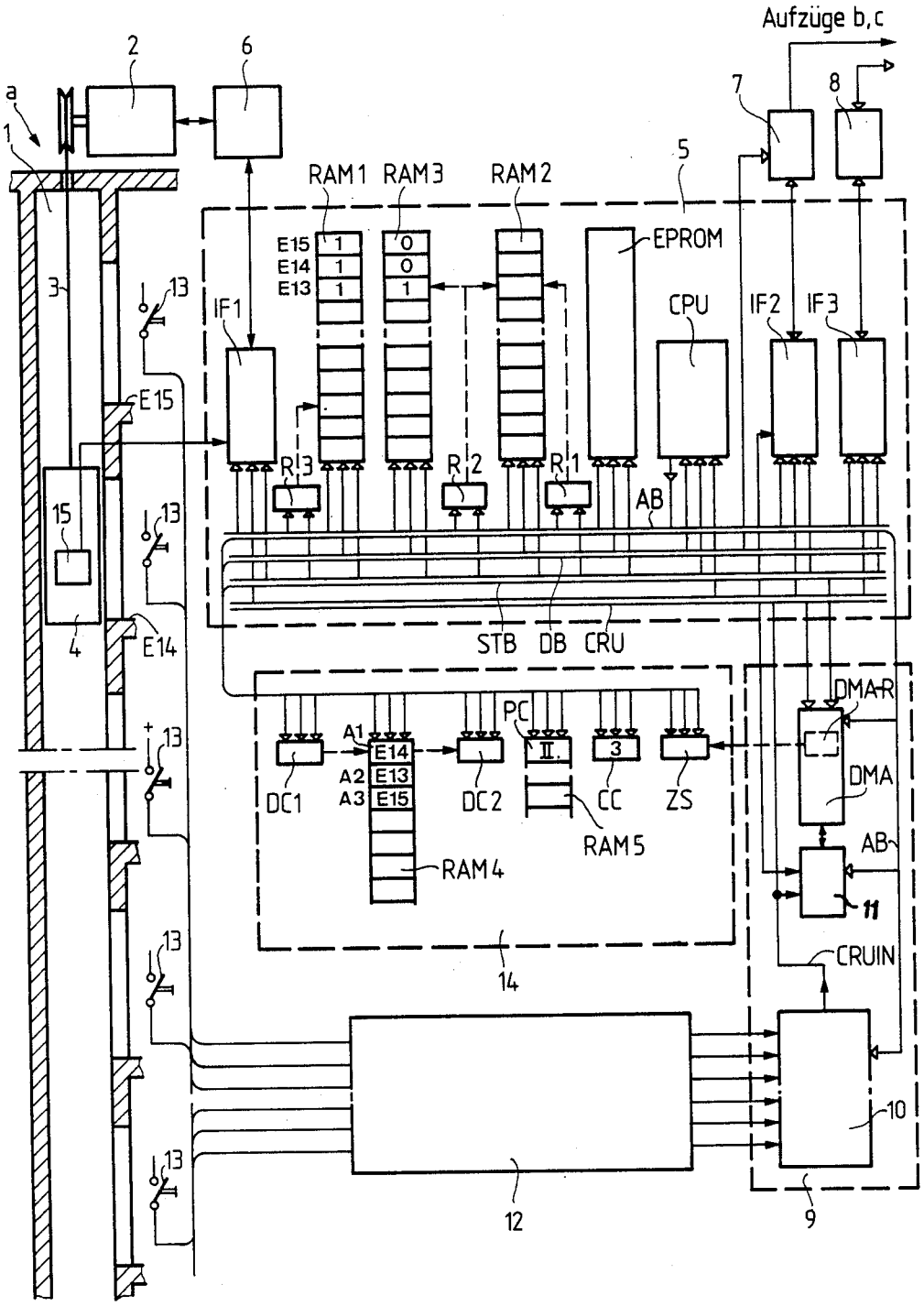
FIG. 1 is a schematic illustration of the group control according to the invention for an elevator comprising an elevator group formed by three elevators.

Describing now the drawings, it is to be understood that only enough of the construction of the group control for an elevator containing an apparatus for controlling the descent or down-peak traffic has been shown as needed for those skilled in the art to readily understand the underlying principles and concepts of the present development, while simplifying the showing of the drawings. Turning attention now specifically to FIG. 1, there has been schematically illustrated therein an elevator shaft or hoistway 1 for an elevator a of an elevator group comprising, for example, three elevators a, b and c. An elevator cabin or car 4 is guided in the elevator shaft or hoistway 1 and is driven by any suitable hoisting or drive engine 2 by means of a hoisting cable 3 or the like. In the elevator system selected for explaining the exemplary embodiment, 15 storeys or floors E1 to E15 are serviced. The hoisting or drive engine 2 or the like is controlled by a drive control which is of the type known and described in detail in European Patent Publication No. 0,026,406, and the corresponding U.S. Pat. No. 4,337,847, granted July 6, 1982 to which reference may be readily had. The drive control comprises a microcomputer system 5 realizing the reference value generation, th automatic regulation or control functions and the stop initiation, and further comprises measuring and adjusting members 6 of such drive control which are connected to the microcomputer system 5 through a first interface IF1. The microcomputer systems 5 of the individual elevators a, b, c are interconnected by a comparator 7 and a second interface IF2 as well as via a party line transmitting system 8 and a third interface IF3. In this manner the microcomputer systems 5 form a group control as known from and described in detail in European Patent Publication No. 0,032,213, and the corresponding U.S. Pat. No. 4,355,705, granted Oct. 26, 1982. By means of this group control the allocations of the elevators a, b, c to the storey or hall calls stored in a storey or hall call storage RAM1 can be optimized in terms of time. Therefore, a microprocessor CPU of the microcomputer system 5 tests during a scanning cycle of a first scanner R1 at each storey or floor whether a storey or hall call is present or not and computes a sum which is proportional to the time losses of waiting passengers from the distance between the storey and the cabin or car position as indicated by a selector R3, from intermediate stops to be expected within that distance and from the instantaneous cabin or car load. The cabin or car load present at the moment of calculation is corrected in such a manner that the probable number of entering passengers or embarkers and exiting passengers or disembarkers at future intermediate stops is derived from the past number of passenger embarkments and passenger disembarkments and taken into account. This sum of loss times, which is also called service or servicing costs is stored in a cost storage or memory RAM2. During a cost comparison cycle, by means of a second scanner R2, the servicing costs of all elevators are compared with each other by the comparator 7. In an allocation or allocating storage or memory RAM3 associated with the elevator having at lowest servicing costs an allocation instruction or statement can be stored in the form of a 1-bit data word which designates the storey or floor to which the corresponding elevator a, b, c can be optimumly allocated with respect to time.

A switching system or arrangement 9 for supplying storey or hall calls to the microcomputer system 5 comprises a peripheral unit 10, a scanning and comparison device 11 and a DMA-component DMA. At its input side the peripheral unit 10 is connected during the descent or down-peak traffic to descent or down-hall call transmitters 13 by means of a transmitting device 12 which will be described in greater detail hereinafter with reference to FIG. 2 and which transmits the descent or down hall calls in the timewise sequence or chronological order of their input. Furthermore, the peripheral unit 10 is connected to an address bus AB and to the data input conductor or line CRUIN of a serial input and output bus CRU of the microcomputer system or microcomputer 5. The scanning and comparison device 11 is connected to the address bus AB, to the data input conductor or line CRUIN, to the second interface IF2 and to the DMA-component DMA, the latter being operatively connected with the serial input and output bus CRU, the address bus AB and the control bus STB of the microcomputer system 5. The switching system or arrangement 9 operates in such a manner that the microprocessor CPU of the microcomputer system 5 signals its readiness for the receipt of interruptions by a release or clearing signal. By means of the release signal the scanning and comparison device 11 and the DMA-component DMA are activated, whereupon the inputs of the peripheral unit 10 are sampled or scanned by addresses of a DMA-address register DMA-R. In that operation the switching state of the descent or down hall call transmitters 13 is compared to a switching state which is stored under the same address in the scanning and comparison device 11. In case of inequality an interruption requirement or command is generated in order to write-in or extinguish a storey or hall call and the stored switching state is compensated or equalled to that of the descent or down hall call transmitter 13.

Reference numeral 14 designates a switching circuit by means of which groups of calls are formed after switching over to descent peak traffic. The switching circuit 14 comprises a waiting list RAM4 forming a write-read storage (random access memory) in which the addresses of the descent or down hall calls are stored in their chronological order of input, a monitoring or control counter CC limiting the number of calls in a call group or, respectively, the number of entering stops of a cabin or car, and a priority counter PC by means of which the priority of the elevators a, b, c is established with respect to the most favorable servicing costs as determined by a comparison operation. Furthermore, the switching circuit 14 comprises a first data counter DC1 for addressing the storage locations or places in the waiting list RAM4, a second data counter DC2 for the transfer of the addresses stored in the waiting list RAM4 to the address bus AB and to an intermediate storage ZS for the transfer of the addresses of the DMA-address register to the waiting list RAM4. The storages or memories RAM4, ZS and the counters CC, PC, DC1 and DC2 are connected via the address bus AB, the control bus STB and a data bus DB to the microcomputer system 5; the counters CC, PC, DC1 and DC2, for example, may form registers of the microprocessor CPU or the counters CC and PC also may be constitituted by RAM storage locations, respectively.

A load measuring or weighing device 15 is arranged in the elevator cabin or car 4 and is connected to the microcomputer system 5 via the interface IF1. During DOWN-peak traffic the load differences are calculated at each entering stop from the data determined by the load measuring or weighing device 15. By forming the arithmetic mean value from the sum of the load differences and the number of entering stops B the average number of entering passengers or embarkers is determined per entering stop or halt, which is also referred to as the entering rate BR. The most frequently occurring entering rate BR is stored in a RAM-storage location RAM5 of the switching circuit 14, in order to be used for the determination of the number of calls in a group of calls, or respectively, the entering stops B as will be explained further hereinafter with reference to FIGS. 4 to 6.

Figure 2:
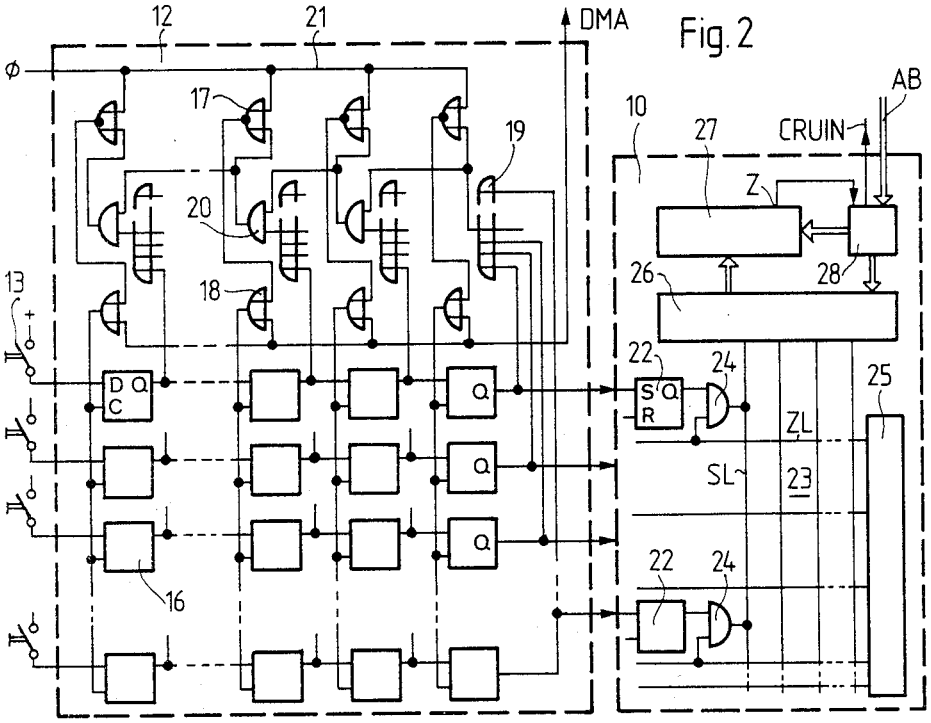
FIG. 2 is a circuit diagram of a transmitting device used in the group control shown in FIG. 1 for transmitting descent or down storey or hall calls in the chronological order of their input.

According to FIG. 2 the transmitting or transfer device 12 for transmitting the descent or down hall calls in the chronological order of their input comprises shift registers 16 each of which, for example, is formed by 12 JK-flip-flops and are operatively associated with the descent or down hall call transmitters 13. The descent or down hall call transmitters 13 are connected to the inputs D of the shift registers 16, on the one hand, and to the positive terminal of a voltage source, on the other hand. Each of the JK-flip-flops in the shift register 16 is operatively associated with a NOR-gate 17, an OR-gate 18, a further OR-gate 19 and, with the exception of the last JK-flip-flop, an AND-gate 20. Each of the NOR, OR and AND-gates 17, 18 and 20, respectively, have two inputs and the further OR-gate 19 has a number of inputs corresponding to the number of shift registers 16. One input of the NOR-gate 17 is connected to a conductor 21 supplied with a timing signal Ø and the other input thereof is connected to the output of the AND-gate 20. The output of the NOR-gate 17 is connected via one input of the OR-gate 18 to the clock inputs C of the JK-flip-flops in the shift register 16, while the other input of the OR-gate 18 is connected to an output of the DMA-component DMA. The outputs Q of the JK-flip-flops in the shift register 16 are connected to the inputs of the further OR-gates 19, the outputs of which are connected to one input of the AND-gates 20, the other inputs of which are respectively connected to the outputs of the preceding AND-gates 20. The outputs Q of the last JK-flip-flops in the shift register 16 are additionally connected to the set-terminals S of RS-flip-flops 22 which are associated with the crossing points of a matrix 23 of the peripheral unit 10. The outputs Q of the RS-flip-flops 22 are each connected to an input of a respective AND-gate 24 having two inputs, the other input of which is connected to a line conductor ZL, and the output of which is connected to a column conductor SL of the matrix 23. The line conductors ZL are activated by a line control 25, the information or data of the RS-flip-flops 22 being received by a column receiver 26, the outputs of which are connected to the inputs of a multiplexer 27.

The transmitting or transfer device 12 and the switching circuit 14 described hereinbefore operate in the following manner:

After switching to descent peak DOWN-peak traffic and actuation of the descent or down hall call transmitters 13, for example, those of the storeys or floors E13, E14 and E15 in the chronological input order E14-E13-E15, the output Q of the shift register 16 associated with the storey or floor E14 is first activated or goes high. By means of the logic elements or gates 17, 18, 19 associated with the last JK-flip-flop the timing signal Ø at this JK-flip-flop is interrupted, so that the output Q thereof further remains at high potential. When the chronologically next-following data or information from storey or floor E13 arrives at the output Q of the relevant next to last JK-flip-flop, the timing signal Ø is also interrupted for this JK-flip-flop via the logic elements 17 to 20 operatively associated therewith. In the same manner the next-following data from the storey or floor E15 is blocked at the output Q of the respective JK-flip-flop which is the second before the last one. During scanning or sampling by means of the addresses in the DMA-address register DMA-R the data of the storey or floor E14 appearing at the output Z of the multiplexer 27 is transferred by a bus driver 28 to the data input conductor CRUIN. It is now assumed that up to this point in time no call has been stored for storey or floor E14. In this case, an interruption requirement is generated and during the progress of an interrupt program this storey or hall call is written into the storey or hall call storage RAM1. Upon reaching the final address in the DMA-address register DMA-R the data in the shift registers 16 is shifted by one step via the OR-gates 18 by means of a corresponding signal. Consequently, the output Q of the shift register 16 associated with the storey or floor E14 is set low while the output Q associated with the storey or floor E13 is set high, whereby the call which is chronologically in second place is prepared for transfer.

The waiting list RAM4 of the switching circuit 14 is now filled in such a manner that, after the chronological first or oldest call from storey or floor E14 has been written-in, a starting address A1 stored in a read-only memory EPROM of the microcomputer system 5 is loaded into the first data counter DC1 in continuation of the interrupt program. Thereafter the address of the chronological first or oldest call, which for simplicity of the description may be equal to the storey or floor E14, is taken over from the DMA-register DMA-R into the intermediate storage ZS and written into the storage location of the waiting list RAM4 and designated by the data counter DC1, see FIG. 1. Then, the data counter DC1 is incremented so as to indicate the address A2. In the elevator group including the three elevators a, b, c upon which the presently described example is based, the interrupt program is concluded at the data counter level DC1≦A3, so that the respectively interrupted program may be continued.

After the addresses E14, E13, E15 of the three calls have been written into the waiting list RAM4 under the addresses A1, A2 and A3, respectively, and at the data counter level DC1=A4 there is called a program for optimum allocation of the chronological first or oldest call from storey or floor E14 to one of the three elevators a, b, or c, respectively. The process is similar to the one described initially, however, the servicing costs will only be calculated and compared for the relevant storey or floor. It may be assumed that, for example, servicing costs are lowest for the elevator b, so that an allocation instruction is written into the allocation storage RAM3 thereof under the address E14 and the priority counter PC thereof is set to the first priority. In the subsequent allocation process for the two elevators a, c and floor the chronological second oldest call from storey or floor E13 the elevator a may be the most favorable one, so that an allocation instruction is written into the the allocation storage RAM3 thereof under the address E13 and the priority counter PC thereof is set to second priority, see FIG. 1. The latest or most recent call from storey or floor E15 is thus allocated to the elevator c and an allocation instruction is written into the associated allocation storage RAM3 under the address E15 and the priority counter PC is set to third priority.

Figure 3:
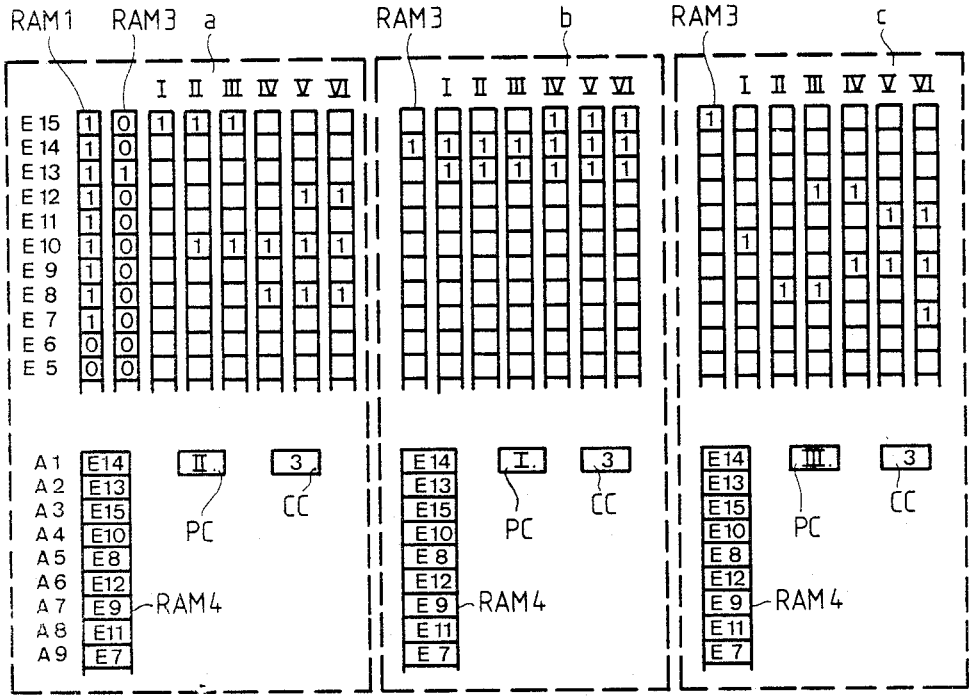
FIG. 3 is a schematic diagram illustrating the formation of storey or hall call groups at different moments of time in the group control shown in FIG. 1.

At a monitoring or control counter level CC=1 indicating the maximum entering stop number B the allocation of the descent or down hall calls, and thus, the formation of groups of calls each including one call would be completed by the procedure just described. No allocation instructions would be written into the allocation storages RAM3 of the elevators a, b, c in the event that further descent or down hall calls arrive. It may be assumed, however, that the monitoring or control counter CC indicates the entering stop number B=3 the determination of which will be explained in more detail with reference to FIGS. 4 to 6. When a fourth descent or down hall call arrives and at the data counter level DC1=A5 a program is called up for forming groups of calls for the elevators a, b, c which include more than one call, each of the call groups comprising a chronological order of calls. In the following description the formation of the groups of calls is explained in greater detail with reference to FIG. 3 and it will be assumed, for example, that six further descent or down hall calls are inputted in the chronological order E10-E8-E12-E9-E11-E7.

After the fourth call from storey or floor E10 is written into the storey or hall call storage RAM1 the chronological second oldest call from storey or floor E13 is also allocated to the elevator b to which the chronological first or oldest call has already been allocated and which is identified by the priority counter PC thereof indicating the first priority. This is accomplished such that the storey or floor address E13 stored in the waiting list RAM4 under the address A2 is transferred to the address bus AB via the second data counter DC2 and that an allocation instruction forming a 1-bit data word "1" is written into the correspondingly addressed storage location of the allocation storage RAM3 (moment of time I). With respect to elevator a which is identified by the priority counter PC indicating second priority the allocation instruction or statement for the chronological second oldest call is cancelled and the allocation statement for the chronological third oldest call from storey or floor E15 is written-in (moment of time I). With respect to the elevator c which has third priority the allocation statement for the chronological third oldest call is cancelled and an allocation instruction for the fourth call from storey or floor E10 is written-in (moment of time I).

After the fifth call from storey or floor E8 has been written into the storey or hall call storage RAM1 and at the data counter state or level DC1=A6 an allocation instruction or statement for the fourth call from storey or floor E10 is written into the allocation storage RAM3 of the elevator a (moment of time II). The allocation instruction for this call is cancelled for the elevator c while an allocation instruction for the call from storey or floor E8 is written-in (moment of time II).

After the sixth call from storey or floor E12 has been written into the storey or hall call storage RAM1 and at a data counter state or level DC1=A7 an allocation instruction for this call is written into the allocation storage RAM3 associated with elevator c (moment of time III).

In the manner described hereinbefore groups of calls can be formed, as in the selected example, which are formed with respect to the elevator a from the allocation instructions for the calls from storeys or floors E10, E8, E12, with respect to elevator b from the allocation instructions for the calls from storeys or floors E14, E13, E15 and with respect to elevator c from the allocation instructions for the calls from the storeys or floors E9, E11, E7 (moment of time VI).

Upon servicing the storey or hall calls in a group of calls the elevator cabin or car firstly services the respective highest call in the group. This is achieved in the following manner: the coincidences of the leading selector position which do not conform in direction and the storey or hall calls are counted and the sum is compared to the monitoring or control counter state or level, the highest storey or floor in a group being found when the number of coincidences is equal to the monitoring or control counter level.

If the monitoring or control counter level is reduced, for example, due to higher entering rates BR, there is called-up a program for the reduction of the groups of calls. Thus, similar to the example as described hereinbefore, the third call is allocated to the elevator a and the sixth call which had been allocated thereto is allocated to the elevator c when the entering stops B=3 change to, for example, B=2 with respect to elevator b. The ninth call which is included in the group of calls associated with the elevator c is cancelled by eliminating the corresponding allocation instruction, however, remains in the waiting list RAM4. After the re-formation of the groups of calls is concluded the data counter DC1 is decremented by one step to the state or level DC1=A9. Now the groups of calls will comprise the allocation instructions for the calls from storeys or floors E15, E10, E8 with respect to elevator a, the allocation instructions for the calls from the storeys or floors E14, E13 with respect to elevator b, and the allocation instructions for the calls from storeys or floors E12, E9, E11 with respect to elevators c. After all calls in the waiting list RAM4 have been attended to the call from storey or floor E7 characterized by the data counter state or level DC=A9 is written into the waiting list RAM4 under the address DC=A1. Thereafter, the calls stored in the transmitting or transfer device 12 can be released for inputting into the microcomputer system 5 and the waiting list RAM4 can be filled anew.

Figure 4:
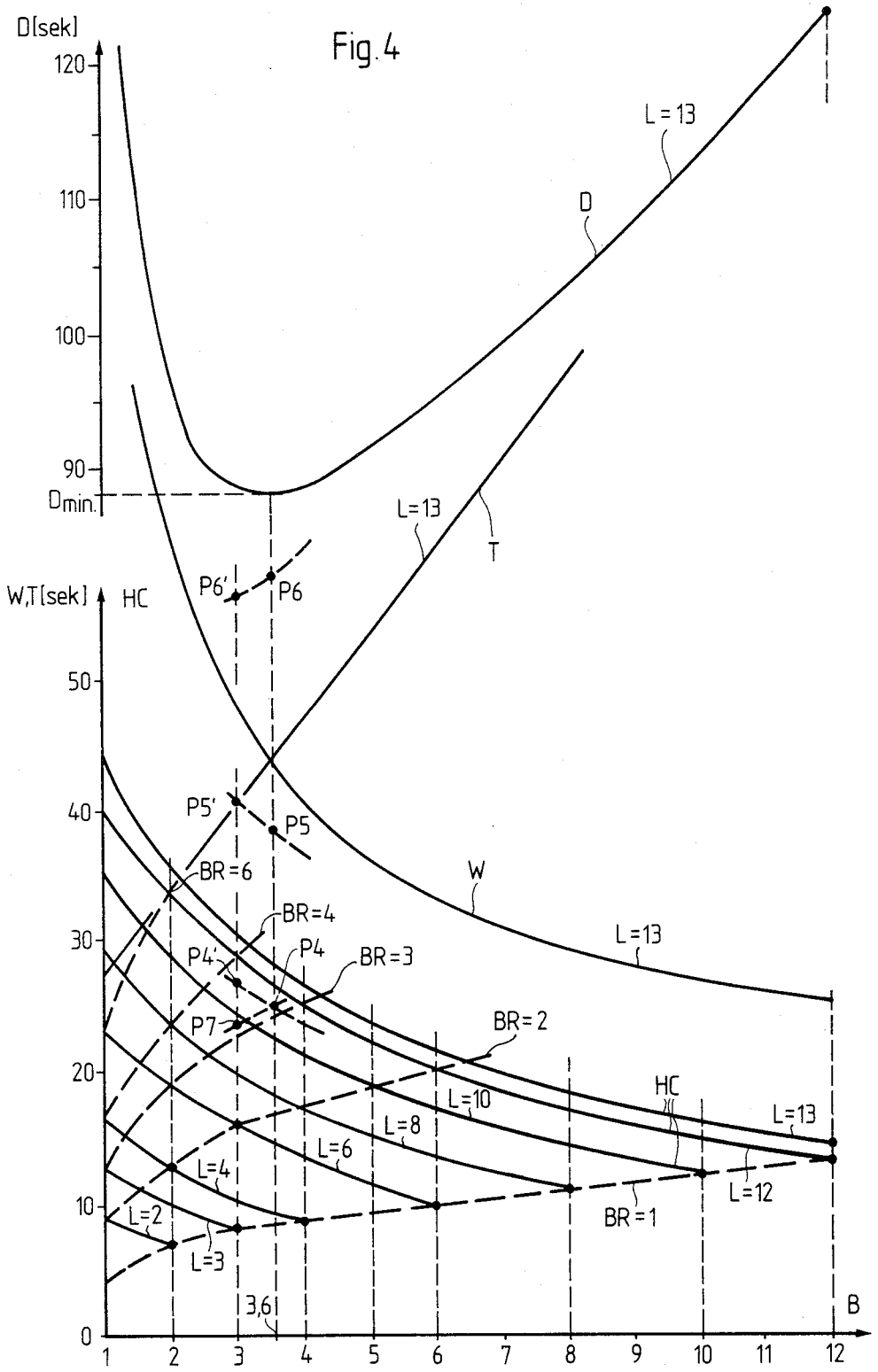
FIG. 4 is a diagram respectively depicting the conveying capacity HC, the average waiting period or time W, the return travel time T and the average system time D of a passenger, each as a function of the number of entering stops B of an elevator cabin or car.

In FIG. 4 the entering stops B of the cabins or cars in the elevator group are plotted along the horizontal axis or abscissa while the conveying capacity HC of the elevator group in persons per minute is plotted along the vertical axis or ordinate. The relation between the conveying capacity HC and the entering stops B is represented by characteristic lines HC and given by the equation:

$$HC = \frac{n \cdot L \cdot 60}{RTT} \text{ [Pers./Min.]} \qquad \text{Eq. 1}$$

wherein:

$$RTT = (h/v)(F+B) + t(B+1) + L \cdot \tau \qquad \text{Eq. 2}$$

represents the cabin or car round trip time in seconds and wherein:

- n is the number of cabins or cars in the elevator group,
- L is the number of disembarkers or exiting passengers at ground floor,
- $\tau$ is the mean passenger disembarking time, usually assumed to be 1 second,
- h is the storey or floor height,
- v is the travel velocity of a cabin or car,
- F is the number of storeys or floors above the ground floor,
- B is the number of entering stops above the ground floor, and
- t is the time loss per stop of a cabin or car.

Additionally, the average waiting time W of a passenger until entry into the cabin or car, the return travel time T to the ground floor, and the average system time D which the passenger spends in toto within the elevator system until disembarkment, are plotted in seconds. The relation between these times and the entering stops B is represented by the characterizing lines W, T and D and by the equations 3, 4 and 5:

$$W = \frac{RTT}{2 \cdot n} \cdot \frac{F}{B} \qquad \text{Eq. 3}$$

$$T = \frac{h}{4 \cdot v}(F + B) + \frac{t}{2}(B + 1) + \frac{L \cdot \tau}{2} \qquad \text{Eq. 4}$$

$$D = W + T \qquad \text{Eq. 5}$$

The letters appearing in the foregoing equations have the same meaning as the letters appearing in the equation for the conveying capacity HC represented by Eq. 1. In the third equation (Eq. 3), by means of which the waiting time W may be calculated for the upper range of cabin or car loads, the factor F/B is a frequency number which indicates at a selected number of entering stops B how many round trips are required to service all storeys or floors F above the ground floor. The lines designated BR are lines of the same entering rates in the conveying capacity-characteristic lines field, the entering rate being understood to indicate the average number of entering persons or passengers at each entering stop.

The number B of entering stops, at which the average system time D is a minimum, is determined by forming the differential quotient:

$$\frac{dD}{dH} = \frac{dW}{dH} + \frac{dT}{dH} \qquad \text{Eq. 6}$$

and by equating the same to zero as follows:

$$B = \sqrt{\frac{\frac{F}{n}\left(\frac{F \cdot h}{v} + t + L \cdot \tau\right)}{\frac{h}{2 \cdot v} + t}} \qquad \text{Eq. 7}$$

For example, the characteristic lines HC, W, T and D in FIG. 4 are based on an elevator group servicing twelve storeys or floors above ground by means of four elevator cabins or cars at a travel velocity of v=2.5 m/s and a maximum disembarker number of L=13 persons. The different characterizing lines HC relate to the conveying capacities HC for L=2, 3, 4, 6, 8, 10, 12 and 13 disembarkers or exiting passengers. The characterizing lines W, T and D are shown for L=13 disembarkers. At lower disembarker numbers the characterizing lines W, T and D deviate downwardly, the characterizing lines for the waiting time W and the system time D being determinable in the manner to be described in greater detail hereinafter with reference to FIGS. 5 and 6.

Figure 5:
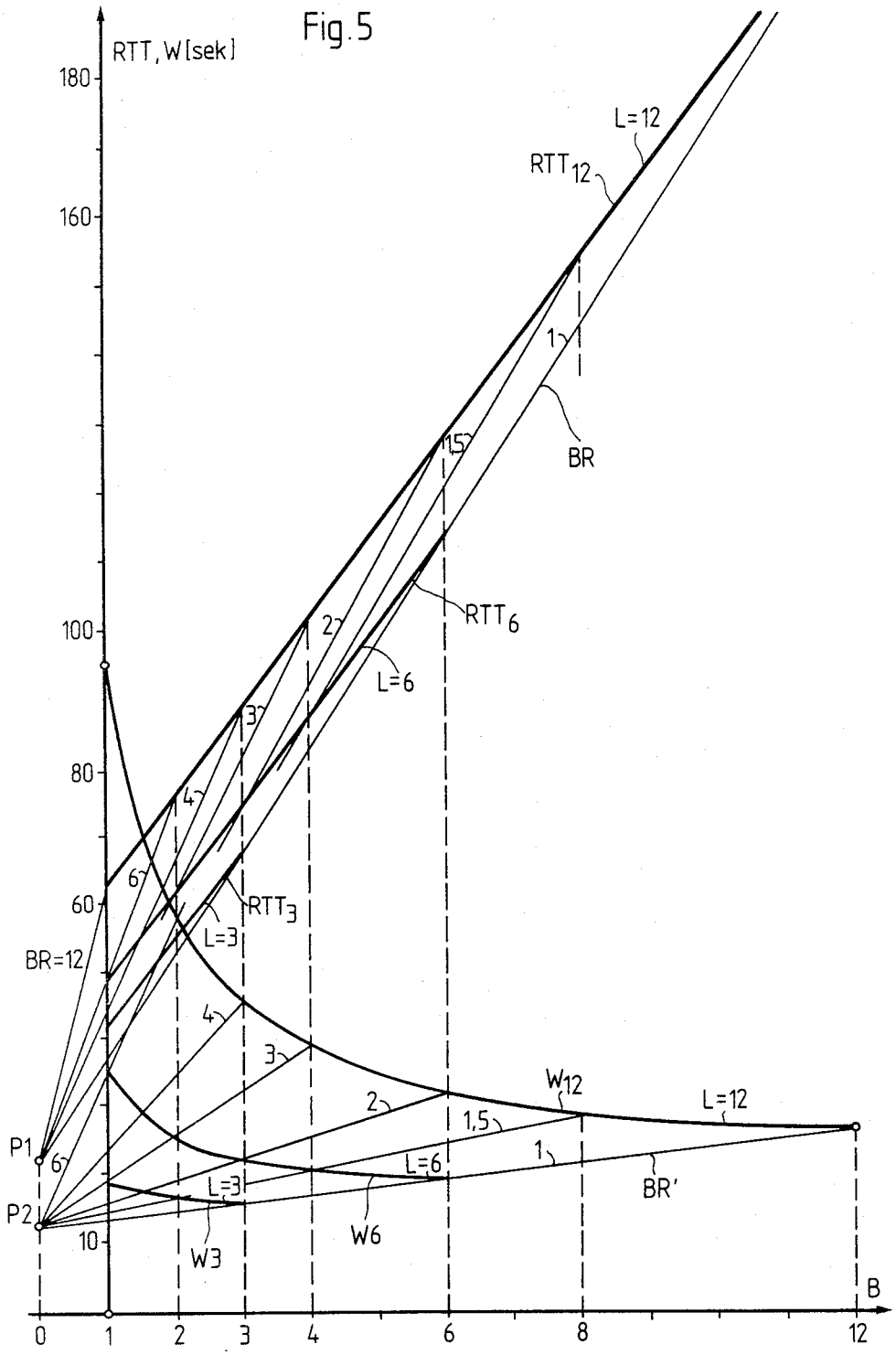
FIG. 5 is a diagram respectively depicting the cabin or car round travel time or round trip period RTT and the waiting time or period W for L=3, 6 and 12 disembarkers, each as a function of the number of entering stops B.
Figure 6:
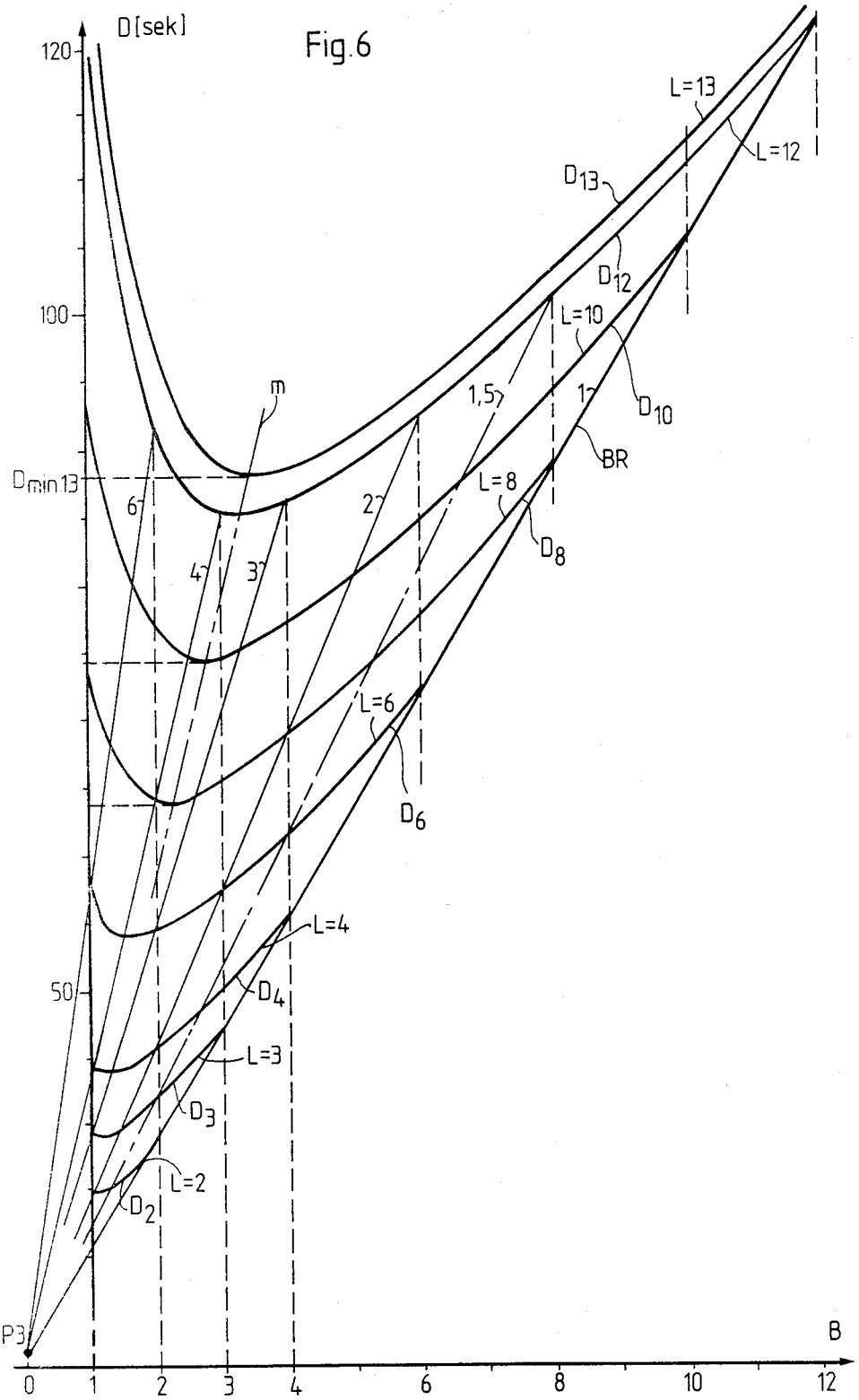
FIG. 6 is a diagram depicting the average system time D for L=2, 3, 4, 6, 8, 10, 12 and 13 disembarkers as a function of the number of entering stops B.

In FIG. 5 there are shown the entering stops B of the cabins or cars in the elevator group on the horizontal axis and, on the vertical axis, the cabin or car round trip time RTT and the average waiting time W of a passenger in seconds until the entry into the cabin or car. The relation between the cabin or car round trip time RTT and the entering stops B is given by Eq. 2 and represented by characterizing lines or characteristics $RTT_3$, $RTT_6$ and $RTT_{12}$ for L=3, 6 and 12 disembarkers. The straight lines designated by BR are lines of equal entering rates, the entering rate being understood to be the number of entering passengers at one entering stop, just as was the case for the conveying capacity-characterizing lines according to FIG. 4. The straight lines BR intersect at a point P1 which, according to Eq. 2, has the ordinate value RTT=F(h/v)+t at B=0.

The relationship between the average waiting time W and the entering stops B in the case of 12 disembarkers is given by equation 3 and represented by the characterizing line $W_{12}$. Assuming that similar to the characterizing lines RTT of the cabin or car round trip times the straight lines BR' of equal entering rates of a waiting-time-characterizing line field also intersect at one point, further characterizing lines for less disembarkers can be determined graphically from the characterizing line $W_{12}$ for 12 disembarkers. Thus, for example, the intersection points of the entering stops B=1,2,3,6 and the straight lines BR'=6,3,2,1 yield the characterizing line $W_6$ for 6 disembarkers. The ordinate for the intersection point of the straight lines BR' designated by P2 results from considering that for only one disembarker:

$$W \cong \frac{1}{2} RTT \qquad \text{Eq. 8}$$

can be set approximately. Using RTT=F(h/v)+t at B=0, the ordinate value for the point P2 is thus obtained as $$W = \frac{1}{2}\left(F\frac{h}{v} + t\right).$$

FIG. 6 again shows along the horizontal axis the entering stops B of the cabins or cars, while the vertical axis is associated with the system time D in seconds. $D_{13}$ designates the system time-characterizing line for 13 disembarkers in accordance with equation 5. Further system time-characterizing lines $D_{12}$, $D_{10}$, $D_8$, $D_6$, $D_4$, $D_3$, $D_2$ for L=12, 10, 8, 6, 4, 3 and 2 disembarkers are determined similar to the waiting time-characterizing lines according to FIG. 5 by straight lines BR of equal entering rates, the straight lines BR intersecting at a point P3 which, according to Eq. 5, has the ordinate value $$D = F\frac{3h}{4v} + t$$

at the entering stop B=0. However, it is also possible to determine the system time D for smaller disembarker numbers L by a calculation in which the waiting times W determined graphically in accordance with FIG. 5 are substituted in Eq. 5. The minima $D_{min}$ of the system time-characterizing lines lie on a straight line m extending at an acute angle with respect to the time axis. It is evident therefrom that the optimum number of entering stops B encompasses a range of 1 to 4 entering stops, depending upon the number of disembarkers L.

If the control of such an elevator system is conceived in this way the calculations as described hereinbefore will yield an initially determined number of entering stops B=3.6 per cabin or car in accordance with Eq. 7. Assuming that in descent or down-peak traffic the maximum number of disembarkers L can be relied upon to occur in 50% of all runs and that the last entering stop B is omitted in the other runs, so that the maximum number of disembarkers L is reduced by one entering rate BR, the average number of disembarkers will be $$L' = L_{max} - \frac{BR}{2} \qquad \text{Eq. 9}$$

wherein, $L_{max}$ is the rated load of the cabin or car. If now, for example, the entering rate BR=3.2 is calculated and stored in the microcomputer system 5 (FIG. 1), the average number of disembarkers L' will be 11.4 on the basis of Eq. 9. Using equations 1 to 5 now the conveying capacity HC, the waiting time W and the system time D can be determined for the number of entering stops B=3.6 (points P4, P5 and P6 in FIG. 4).

At the entering stop number B=3.6 the monitoring counters CC of the switching circuits 14 for the elevators a, b, c may be set to B=4 by the party line-transfer system 8 (FIG. 1). Since now, as assumed in the foregoing, the average entering rate BR=3.2, the arrival load $L_{max}$ of 13 persons to be expected is not exceeded, so that the number of entering stops B=4, and thus, the number of storey or hall calls allocated per cabin or car can be maintained for the further progress or run of the control operation. If an average entering rate of, for example, BR=3.6 is determined, the maximum permissible arrival load $L_{max}$ of 13 persons would be exceeded with four entering stops. In such case a corresponding program is called-up in the microcomputer system 5 to reduce the state or level of the monitoring or control counter CC to an entering stop number B=3 which is also in the minimum range of the system time D. Consequently, the conveying capacity HC is improved, the waiting time W increases only slightly and the system time D is somewhat decreased (points P4', P5' and P6' in FIG. 4).

If the control is conceived without taking into account the relationships as described hereinbefore and if the number of entering stops is established, for example, at B=3 according to empirical points of view, then the cabin or car will not be fully utilized at an entering rate of BR=3.2 in respect of the aforementioned example and the conveying capacity will be correspondingly smaller (point P7 in FIG. 4). At an entering rate, for example, of 5 only two entering stops are possible, so that the third allocated storey or hall call will be passed by.

While there are shown and described present preferred embodiments of the invention, it is to be distinctly understood that the invention is not limited thereto, but may be otherwise variously embodied and practiced within the scope of the following claims. Accordingly,

What I claim is:

1. A group control for elevators including a number of elevator cars of an elevator group and containing an apparatus for controlling the DOWN-peak traffic by means of which a defined number of down hall calls is allocated to each elevator car in the elevator group, said group control comprising:

a hall call storage containing first storage locations;

a number of switching circuits, each switching circuit being operatively associated with a respective one of said cars;

a monitoring counter contained in each switching circuit;

said monitoring counter storing said defined number of down hall calls and limiting a number of entering stops for the relevant car associated with said switching circuit to said stored defined number;

waiting list means provided for each of said switching circuits and containing second storage locations;

said down hall calls being stored in said second storage locations of said waiting list means in their chronological input sequence;

a number of allocating storages to each of which a respective one of said switching circuits is connected and each of which allocating storages contains third storage locations operatively associated with said first storage locations;

said third storage locations of said allocating storages storing allocation instructions limited to a control counter state of its related monitoring counter, said allocation instructions being associated with the chronologically consecutive down hall calls stored in said waiting list means, to thereby form groups of hall calls;

a respective priority counter provided for each switching circuit;

each priority counter being associated with a respective one of said cars and being settable to a priority number corresponding to the chronological age of a hall call such that upon storing a respective latest call in said waiting list means the respective earliest hall call is allocated by storing a respective allocation instruction to that one of said cars which will most rapidly service said respective earliest hall call;

said groups of hall calls, upon arrival of a further hall call, being sequentially increased in their order of priority such that the respective earliest hall call in one of said groups is transferred to another one of said groups associated with one of said cars having the next-higher priority and the respective latest hall call is allocated to the car having the lowest priority; and said groups of hall calls being generated in the same size with respect to one another until said number of down hall calls stored in said monitoring counter is reached.

2. The group control as defined in claim 1, further including:

a computer to which each of said switching circuits is connected;

load weighing devices, each of which is operatively associated with a respective one of said cars and operatively connected to said computer;

said computer determining an average entering rate on the basis of determination of a load difference between an arrival load and a departure load at each entering stop and by forming an arithmetic mean value of said load differences determined for a preceding last number of entering stops;

a fourth storage location for storing said average entering rate;

a comparator with which each said switching circuit is connected; and said comparator comparing a product formed by said average entering rate and said defined number of entering stops indicated by said monitoring counter with a limiting value for reducing said defined number of said entering stops in the event that said limiting value is exceeded.

3. The group control as defined in claim 1, wherein:

addresses are associated with floors of said down hall calls;

said waiting list means comprises a read-write memory;

said addresses are adapted to be written into said read-write memory; and a data counter for addressing said second storage locations of said waiting list means.

4. The group control as defined in claim 1, wherein:

each said allocating storage comprises a read-write memory; and said allocation instructions comprise 1-bit data words.

5. The group control as defined in claim 2, further including:

a data counter for addressing said second storage locations of said waiting list means;

said computer and said comparator are constituted by a microcomputer system; and said waiting list means, said allocating storage, said monitoring counter, said priority counter and said data counter are integrated into said microcomputer system.

6. The group control as defined in claim 1, wherein:

said defined number of down hall calls stored in said monitoring counter or, respectively, said entering stops are determined for each car in accordance with the relationship:

$$B = \sqrt{\frac{\frac{F}{n}\left(\frac{F \cdot h}{v} + t + L \cdot \tau\right)}{\frac{h}{2 \cdot v} + t}}$$

wherein:

F represents the number of floors above the ground floor, n represents the number of cars in the elevator group, h represents the floor height, v represents the car travel speed, t represents the time loss per car, L represents the number of disembarkers at the ground floor and $\tau$ represents the mean passenger disembarking time.

7. A group control for elevators including a number of elevator cars of an elevator group and containing an apparatus for controlling the DOWN-peak traffic by means of which a defined number of down hall calls is allocated to each elevator car in the elevator group, said group control comprising:

a hall call storage containing first storage locations;

a number of switching circuits, each switching circuit being operatively associated with a respective one of said cars;

a monitoring counter contained in each switching circuit;

said monitoring counter storing said defined number of down hall calls and limiting a number of entering stops for the relevant car associated with said switching circuit to said stored defined number;

waiting list means provided for each of said switching circuits and containing second storage locations;

said down hall calls being stored in said second storage locations of said waiting list means in their chronological input sequence;

a number of allocating storages to each of which a respective one of said switching circuits is connected and each of which allocating storages contains third storage locations operatively associated with said first storage locations;

said third storage locations of said allocating storages storing allocation instructions limited to a control counter state of its related monitoring counter, said allocation instructions being associated with the chronologically consecutive down hall calls stored in said waiting list means, to thereby form groups of hall calls;

a respective priority counter provided for each switching circuit;

in the presence of n elevators and upon storing the n-th call in the waiting list means there is successively allocated the momentary oldest call, by storing an allocation instruction, to that car which can most rapidly service such oldest call, and said priority counter of the related car being settable to a priority number corresponding to the age of the call; and upon occurrence of further calls the call groups are successively increased by one call in the sequence of their priority in such a manner that the oldest call of a call group is transferred into the call group of the car of next-higher priority and the most recent call of the call group is allocated to the car of lowest priority, and there are formed call groups of the same size until the control counter state is reached.

* * * * *

UNITED STATES PATENT AND TRADEMARK OFFICE

CERTIFICATE OF CORRECTION

PATENT NO. : 4,492,288

DATED : January 8, 1985

INVENTOR(S) : Joris Schroder

It is certified that error appears in the above-identified patent and that said Letters Patent is hereby corrected as shown below:

Column 1, line 21, after "peak" and before "down-peak" please insert --or--

Column 1, line 23, after "each" and before "cabin" please insert --car or--

Column 1, line 30, please delete "quiting" and insert --quitting--

Column 1, line 62, after "peak" please insert --or down-peak--

Column 2, line 40, please delete "cam" and insert --car--

Column 2, line 46, after "storey" please insert --or hall--

Column 4, line 27, please delete "th" and insert --the--

Column 4, line 48, after "storey" please insert --or floor--

Column 5, line 41, please delete "descent peak" and insert --down-peak--

Column 6, line 60, after "peak" and before "DOWN-peak" please insert --or--

Column 7, line 62, please delete "floor" and insert --for--

Signed and Sealed this

*Eighth* Day of *October 1985*

[SEAL]

*Attest:*

*Attesting Officer*

DONALD J. QUIGG

*Commissioner of Patents and Trademarks—Designate*